United States Patent [19]

Neumann

[11] 4,363,276

[45] Dec. 14, 1982

[54] RAILROAD CAR TRUCK SIDE FRAME - BOLSTER CONNECTION

[75] Inventor: Otto W. Neumann, Itasca, Ill.

[73] Assignee: AMSTED Industries Incorporated, Chicago, Ill.

[21] Appl. No.: 187,586

[22] Filed: Sep. 15, 1980

[51] Int. Cl.[3] ..... B61F 5/052

[52] U.S. Cl. ..... 105/197 R; 105/205; 105/206 R

[58] Field of Search ..... 105/197 R, 197 A, 197 B, 105/197 D, 197 DB, 197 DH, 197 DP, 197.1, 197.2, 206 R, 206 A, 207, 208, 208.1, 208.2, 205, 182 R

[56] References Cited

U.S. PATENT DOCUMENTS

| | | | |
|---|---|---|---|
| 1,029,582 | 6/1912 | Beasley | 105/197 R |
| 1,717,648 | 6/1929 | Barrows | 105/197 R |
| 2,012,949 | 9/1935 | Drenning | 105/206 R |
| 2,036,858 | 4/1936 | Drenning et al. | 105/205 X |
| 2,097,579 | 11/1937 | Symington | 105/205 |
| 2,181,709 | 11/1939 | Schenck et al. | 105/205 |
| 2,200,571 | 5/1970 | Barrows | 105/197.2 |
| 3,354,837 | 11/1967 | Williams | 105/197 R |
| 4,254,712 | 3/1981 | O'Neill | 105/197 DB |

*Primary Examiner*—Joseph F. Peters, Jr.
*Assistant Examiner*—M. J. Hill
*Attorney, Agent, or Firm*—Edward J. Brosius; Fred P. Kostka; Tony T. Shu

[57] ABSTRACT

A railroad car truck may be assembled by spacing a pair of side frames to which is connected a transversely positioned bolster. End portions of the bolster are located within a window formed in a middle portion of each side frame to form a connection therebetween. Each side frame-bolster connection includes vertical cushioning provided by a set of coil springs interposed between a lower compression member of the side frame window and a bottom wall of the bolster. To damp the vertical cushioning of the bolster a pair of friction shoes carried by the bolster interact with wear plates fastened to vertical columns of the windows. The friction shoes impede bolster rotation which is maintained between fixed limits by contact between adjacent structural members of the bolster and side frame. To prevent undue flexing of the side window columns a stiffening rib may be selectively added to the columns.

1 Claim, 6 Drawing Figures

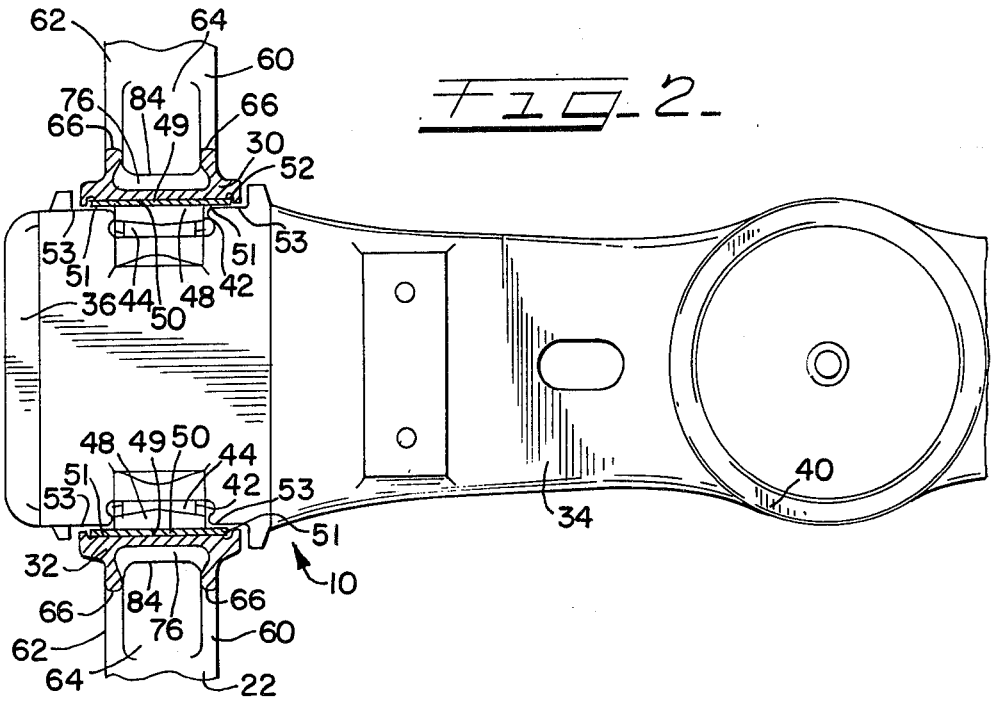
FIG. 2
FIG. 1
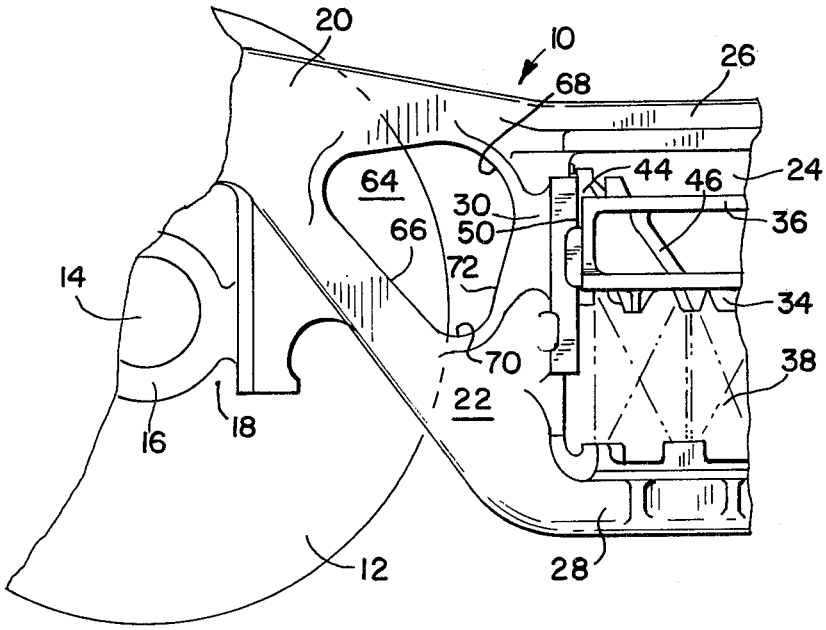

RAILROAD CAR TRUCK SIDE FRAME - BOLSTER CONNECTION

BACKGROUND OF THE INVENTION

1. Field of Invention

This invention relates to railroad car trucks and more particularly to an improved connection between a side frame and a bolster of said truck.

2. Prior Art

A modern railroad car truck forming part of a railroad car is commonly referred to as a 3-piece truck in that a pair of spaced side frames resiliently carry a transversely positioned bolster. End portions of the bolster are positioned in windows in each side frame to form a loose connection therebetween. This connection includes sets of coil springs to provide vertical cushioning of the bolster which in turn support a body of the railroad car thereabove.

To dampen vertical oscillating inherent with coil spring suspension, each bolster end portion is formed with a pair of pockets which contain friction shoes. The friction shoes in turn interact with wear plates fastened to spaced vertical columns defining in part the side frame windows. The amount of dampening provided by the friction shoes may be constant or variable depending upon whether or not a spring on which the shoe is supported is compressed by the vertical movements of the bolster. In either case, the spring forces the shoe upwardly against a sloped guide surface to push the shoe outwardly to contact the side frame window wear plate. This contact assists in maintaining the side frame and bolster in a squared relationship as well as providing frictional dampening.

Where the frictional engagement between the shoe and side frame window wear plate is constant, the bolster may be formed with outwardly projecting pair of vertical gibs on each side of the friction shoe windows. The gibs engage with end walls of the side frame column to limit bolster rotation. When side frame-bolster rotation occurs, the window columns are duly stressed to cause deformation of the columns.

Where the frictional engagement between the shoe and side frame window wear plate is variable, the wear plate extends beyond the friction shoe pocket. During bolster rotation, engagement between the wear plate and lands formed on the bolster on each side of the friction shoe pocket can occur. This engagement limits bolster rotation but also causes side frame window column deformation.

SUMMARY OF THE INVENTION

In the railroad car truck of this invention, the side frame window columns are stiffened to provide improved results. Stiffening is achieved by forming a selectively shaped horizontal support web on an outer side of each side frame window column. The web connects spaced end walls of the side frame to the column at its proximate mid point to strengthen the entire cross-sectional area of the column. This stiffened side frame window column produces several improvements to the side frame-bolster connection.

First, the column has improved strength to withstand greater forces associated with higher load capacity railroad cars. Secondly, maintaining wear plate flatness in both the horizontal and vertical directions optimizes the frictional interaction between the friction shoe and the wear plate. Maximizing surface contact between the shoes and the wear plates promotes uniform wear characteristics and insures proper regulation of vertical oscillating of the bolster.

Next, side frame-bolster squareness is enhanced. Rotation of the bolster is restricted because the column has improved flex resistance. Because the column resists flexing in both horizontal and vertical directions, yaw, roll and pitch rotation of the bolster is better controlled.

Lastly, stiffening of the side frame column with a horizontal support rib provides an easy to apply solution to the complicated environment of the side frame-bolster connection. Dynamic and static forces transmitted during the operation of a railroad freight car are extremely complex and therefore difficult to analyze. Thus, there is no quick and obvious means to provide an improved side frame-bolster connection.

DESCRIPTION OF THE DRAWINGS

FIG. 1 is a side elevational view of a portion of a railroad car truck.

FIG. 2 is a plan view in partial section of a portion of the railroad car truck in FIG. 1.

DESCRIPTION OF THE PREFERRED EMBODIMENT

Figure 5:
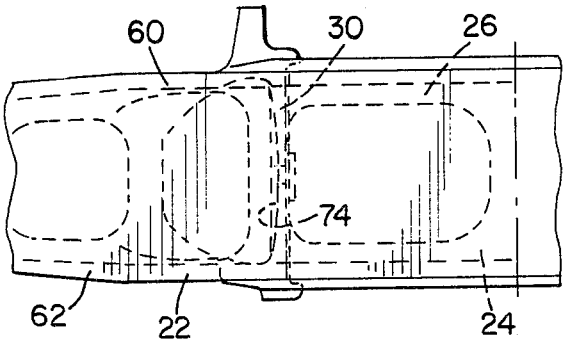
FIG. 5 is a plan view of a portion of the side frame as seen generally along the line 5—5 of FIG. 3.
Figure 6:
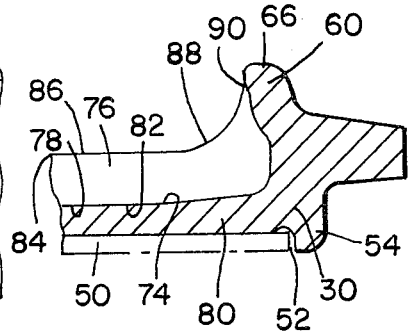
FIG. 6 is a cross-sectional view of the side frame as seen generally along the line 6—6 of FIG. 4.
Figure 3:
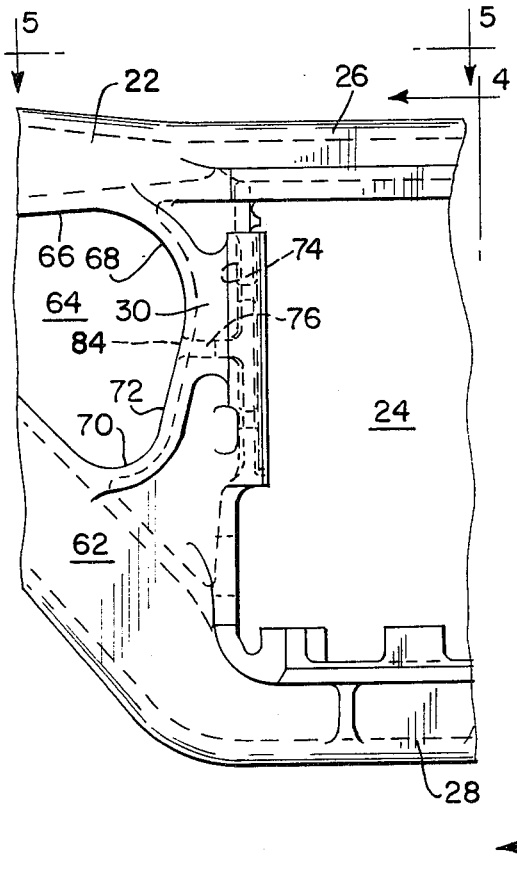
FIG. 3 is a detailed side elevational view of a side frame of the truck of FIG. 1.
Figure 4:
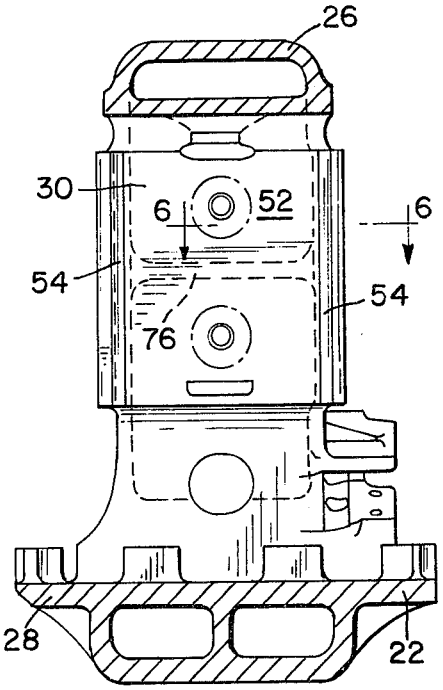
FIG. 4 is a cross-sectional view of the side frame as seen generally along the line 4—4 of FIG. 3.

A railroad car truck is shown generally in FIGS. 1 and 2 and designated 10. The truck 10 has a pair of wheelsets with a portion of one wheelset 12 shown. An axle end 14 of the wheelset 12 is journaled in a bearing 16 carried in a pedestal jaw 18 formed at an end 20 of a side frame 22. As is well known, the truck 10 has a pair of spaced side frames 22 to provide four pedestal jaws 18 for an equal number of wheelset axle ends 14.

In a center of the side frame 22 is a window 24 defined by a top compression member 26 and a bottom tension member 28. The compression and tension members 26, 28 are joined by spaced front and rear vertical side frame columns 30, 32. A bolster 34 is positioned transversely between the side frames 22 with outer ends 36 of the bolster 34 located one each in the side frame windows 24 to form a connection therebetween. Each bolster outer end 36 is resiliently carried by a set of springs. One such spring set 38 is shown diagrammatically in FIG. 1. In a center portion of the bolster 34 is a center plate 40 forming part of a center plate connection with a body (not shown) of a railroad car (not shown).

In the outer bolster end 36 is a pair of friction shoe pockets 42 formed in a back-to-back relationship. In each pocket 42 is a friction shoe 44. The configuration of the pocket 42 and shoe 44 may vary. The shoe 44 may have, for example, a simple triangular-shaped configuration or be a winged-typed shoe. In each case, the shoe 44 is carried on a spring which forces the shoe 44 into engagement with a sloped guide surface 46 in the pocket 42. This engagement pushes the shoe 44 outwardly so that a vertical friction wall 48 of the shoe 44 is pressed against a wear plate 50 fastened to each side frame window column 30, 32.

The amount of force provided by the spring on the shoe 44 may be constant or variable. Where the force is constant, the spring rests on a member which moves up and down with the bolster 34, for example, a bottom wall of the bolster 34. Where the force is variable, as shown in FIG. 1, the spring forms part of the spring set 38 so that the force applied to the shoe 44 varies as the bolster 34 moves up and down.

As seen in FIG. 2, the friction shoe vertical friction wall 48 engages a center portion 49 of the wear plate 50. Edge portions 51 of the plate 50 extend beyond the shoe 44 and align with lands 53 formed as part of the bolster 34 on each side of the friction shoe pocket 42.

Where a winged-type friction shoe is used, there is substantial alignment between the vertical friction wall of the shoe and the wear plate. In this case, the bolster 34 may be formed with a pair of vertical gibs (not shown) to contain the side frame window columns 30, 32 therebetween.

Each wear plate may be positioned within a recess 52 defined by raised outer side 54 of the side frame window columns 30, 32. The raised outer sides 54 are formed as an integral part of spaced inner and outer end walls 60, 62 of the side frame 22. Within each end wall 60, 62 on each side of the side frame window 24 is a triangular-shaped opening 64. Each opening 64 is defined by a peripheral edge 66 having a rounded surface. The edges 66 converge inwardly.

Each edge 66 includes upper and lower rounded corners 68, 70 located at ends of a slightly upwardly and inwardly sloped edge portion 72.

To an outer side 74 of the front and rear side frame window columns 30, 32 is a rib 76 which extends laterally between the side frame inner and outer end walls 60, 62. The rib 76 has an inner edge 78 which is integrally joined to the column outer side 74. Because each column 30, 32 has flared ends 80, end portions 82 of the inner edge 78 are outwardly sloped.

An outer edge 84 of the rib 76 is defined by a substantially straight middle portion 86 positioned parallel to the wear plate 50. The middle portion 86 is joined to radiused end portion 88 having an outer end point 90 which connects with the opening edge 66.

During operation of the railroad car, the truck 10 is subjected to a complex set of varying dynamic and static forces. The static forces are primarily gravitational in nature originating from the railroad car body in an empty or full condition. These static forces are transmitted from the bolster 34 to the wheelsets 12 through the side frame bolster connection. The dynamic forces are generated from a number of activities, for example, coupling of the railroad car and car travel comprising changes in velocity and changes in direction. These forces combine to cause the bolster 34 to move in all six directions both linearly and rotationally.

Vertical movements of the bolster 34 are cushioned by the spring sets 38. The oscillating phase of these vertical movements is dampened by engagement of the friction shoes 44 with the side frame window wear plate 50. When the bolster 34 yaws, i.e. rotates horizontally about its vertical axis, or rolls, i.e. rotates about its longitudinal axis, adjacent structural members of the bolster 34 and side frames 22 come into contact to stress the side frame window columns 30, 32. The bolster structure which actually makes contact with the side frame window columns 30, 32 depends on whether a variable or constant force is applied to the friction shoes 44 as discussed above. During this contact, each column 30, 32 remains flex resistant in that the rib 76 resists any horizontal or vertical column flexing. This flex resistance promotes car plate flatness so that the friction shoes 44 may properly interact with the wear plates 50.

While various modifications may be suggested by those versed in the art, it should be understood that I wish to embody within the scope of the patent warranted hereon, all such modifications as reasonably and properly come within the scope of my contribution to the art.

What is claimed is:

1. A railroad car truck comprising a pair of spaced side frames formed with pedestal jaws to receive in a journaled relationship axle ends of a pair of wheelsets, each said side frame having formed therein a centrally located window for disposition of end portions of a bolster transversely positioned between said side frames, an upper compression member and a lower tension member, spaced side frame columns joining said compression and tension members to define said side frame window, two wear plates each fastened to an inner side of each said side frame column, spaced side frame inner and outer end walls joining outer sides of said side frame columns, an opening formed in each said end wall with each said opening defined in part by an inner edge portion positioned in proximate alignment with said side frame column, and a horizontal support rib formed on each of said column outer sides with said rib having ends joining said side frame inner and outer end walls so as to minimize torsion twisting, said horizontal support rib having an outer edge defined by a middle portion positioned in substantial alignment with said side frame column wear plate and radiused ends joined to said middle portion with an outer end point of each radiused portion joined to said side frame inner and outer end wall opening edges, wherein said side frame columns tend to remain substantially aligned during rotation of said bolster with respect to said side frames to cause contact therebetween with said wear plates remaining substantially flat to provide a substantial area of contact with friction shoes carried by said bolster.

* * * * *